United States Patent [19]

Alberghini et al.

[11] Patent Number: 4,804,097

[45] Date of Patent: Feb. 14, 1989

[54] BOTTLE WITH NON-EVERTING HAND GRIP

[75] Inventors: Alfred C. Alberghini, Dunwoody; Stephen R. Lynn, Douglasville, both of Ga.

[73] Assignee: Sewell Plastics, Inc., Atlanta, Ga.

[21] Appl. No.: 87,042

[22] Filed: Aug. 19, 1987

[51] Int. Cl.[4] ..... B65D 1/02; B65D 23/00; B65D 23/10

[52] U.S. Cl. ..... 215/100 A; 215/1 C; 220/72; 220/94 A

[58] Field of Search ..... 215/1 C, 100 A, 1 R; 220/94 A, 94 R, 72; D9/378, 380, 383, 410, 396, 397, 411, 404

[56] References Cited

U.S. PATENT DOCUMENTS

| | | | |
|---|---|---|---|
| D. 198,404 | 6/1964 | Busch | D9/411 X |
| D. 277,551 | 2/1985 | Kerr | 215/1 C X |
| D. 279,167 | 6/1985 | Haney et al. | 215/100 A X |
| D. 282,349 | 1/1986 | Larson et al. | 215/1 C X |
| 3,468,443 | 9/1969 | Marcus | 215/1 C |
| 3,536,223 | 10/1970 | Muhlhoff et al. | 215/1 C |

FOREIGN PATENT DOCUMENTS

| | | | |
|---|---|---|---|
| 1985587 | 10/1986 | European Pat. Off. | 215/1 R |
| 2528389 | 12/1983 | France | 215/1 C |

*Primary Examiner*—Sue A. Weaver

*Attorney, Agent, or Firm*—Barnes & Thornburg

[57] ABSTRACT

A thin-walled plastic bottle has hand-grip indentations each of which are formed by a pair of vertical surfaces unitarily joined together along a common edge and inclined with respect to each other at an obtuse angle, generally greater than about 145°. A plurality of horizontal reinforcing ribs protrude outward over major portions of the first and second surfaces including the common edge, the reinforcing ribs inhibiting the everting of the hand-grip indentations.

12 Claims, 1 Drawing Sheet

BOTTLE WITH NON-EVERTING HAND GRIP

BACKGROUND OF THE INVENTION

The present invention is directed to thin-walled containers, particularly those composed of a strain hardened polymer, having a portion of the side wall of the container formed to permit the container to be gripped between a thumb and fingers of one hand.

Thin-walled thermoplastic polymeric containers have been adapted for use to contain a wide range of products. The advantageous features of such thin walled polymeric containers are well known and include the low cost of production, and light weight which contributes to reducing the transportation costs for the goods contained within such containers. Some containers have been designed to include a pair of opposed, inwardly projecting, indentations on opposite sides of the container which indentations are so situated as to permit the container as a whole to be easily grasped between the thumb and fingers of one hand. While such indentations enhance the handling characteristics of the bottle relative to pouring liquid product from the bottle, the hand-grip indentations have presented some problems.

When containers having hand-grip indentations of the type generally discussed above are to be filled with liquid, the position of the fill line within the container is generally designed taking into account the volume occupied by the hand-grip indentations themselves. In the event that the hand-grip indentations evert to an outwardly projecting rather than an inwardly projecting position, the total volume of the container generally increases thereby lowering the level of product within the container. Where consumers are accustomed to seeing product within a container at a given level, the presence of everted indentation presents the disturbing appearance of there being less than the normal amount of product within the container which, in turn, detrimentally affects the customer's willingness to buy the product within the container.

The everting of the hand-grips has been observed to occur quite easily, particularly in the 1.75 liter size commonly used in the liquor industry. It has been observed that the hydraulic shock caused by the dropping of a full container less than two feet can cause conventional hand-grip indentations to evert. Where the containers are warm due to the environmental conditions imposed by shipment during hot weather, the everted hand-grip indentations may take a set in the outwardly projecting position to such a point that the hand-grips of the container will not retain the initially designed, inwardly projecting configuration.

SUMMARY OF THE INVENTION

In containers constructed according to the present invention, the hand-grip indentations comprise first and second vertical surfaces unitarily joined together at a common edge, the two surfaces being inclined with respect to each other at an obtuse angle, generally greater than about 145°. A plurality of reinforcing means having the general form of horizontal ribs extend continuously over major portions of the first and second surfaces including the common edge between the surfaces, the reinforcing means inhibiting the everting of the hand-grip indentations.

One feature of the present invention is that the angle joining the first and second surfaces is sufficiently large that no "over center" condition is achievable. Another feature of the present invention is that the presence of the horizontal reinforcing means subject the hand-grip indentation to a tensional force acting counter to any hydraulic shock thereby inhibiting the everting of the indentation. Other specific features and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DESCRIPTION OF THE PREFERRED EMBODIMENT

Figure 1:
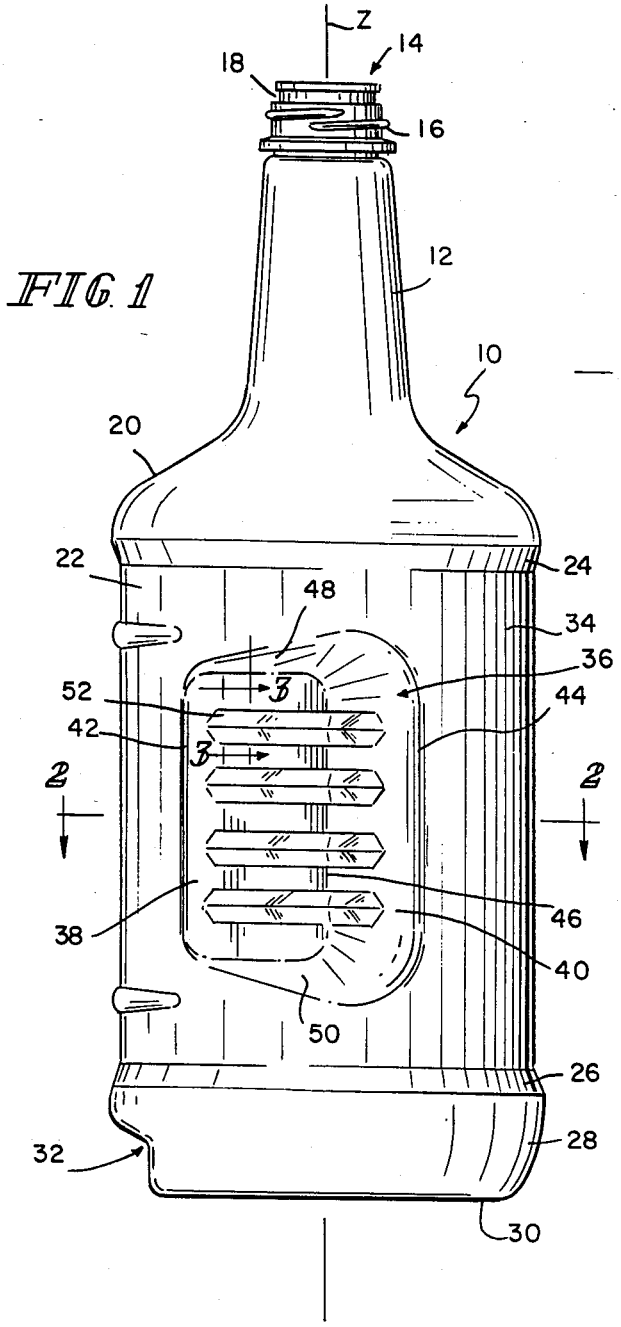
FIG. 1 is an elevation view of one side of a bottle in accordance with the present invention.

A container 10 in accordance with the present invention is shown in FIG. 1. The container is generally composed of a strain-hardened polymer, preferably a biaxially oriented polyester such as polyethylene terephthalate.

The container 10 comprises generally a neck portion 12 terminating at its upper end in an opening 14 through which the bottle is filled and the content thereof is dispensed. The neck portion 12 generally includes a finish 16 for receiving a cap (not shown). The illustrated finish is intended to receive a threaded closure (not shown). The finish also includes a ring indentation 18 adapted to receive a separate pouring dispenser of conventional design used in the liquor industry (not shown).

The lower end of the neck portion 12 flares outwardly at shoulder 20 to join body portion 22. The body portion 22 extends from an upper merger zone 24 merging the body 22 to shoulder 20 down to a lower merger zone 26 merging the body portion 22 to bottom portion 28. Bottom portion 28 has a lower surface 30 intended to support the bottle 10 with respect to horizontal surfaces such that the axis Z is oriented substantially vertically. The bottom portion 28 is shown to include a heel portion 32 for orienting the container during filling operations.

The body portion 22 is shown to comprise a generally cylindrical side wall 34 which is generally equal-distant from the axis of rotation Z. The generally cylindrical side wall 34 is interrupted by an opposed pair of indentations 36 which permit the container to be easily gripped between a thumb and fingers of one hand. The relationship between the two indentations 36 is shown most clearly in FIG. 2.

The indentations 36 each include a first vertical surface 38 and a second generally vertical surface 40. The vertical surfaces 38 and 40 have outside edges 42 and 44 respectively which unitarily join the cylindrical side wall 34. The first and second surfaces 38 and 40 have a common edge 46 continuously joining the two surfaces 38 and 40. Each of the indentations further include an upper and lower generally triangular portions 48 and 50 which unitarily join the top and bottom edges of the first and second surfaces to the cylindrical body portions 22.

Figure 2:
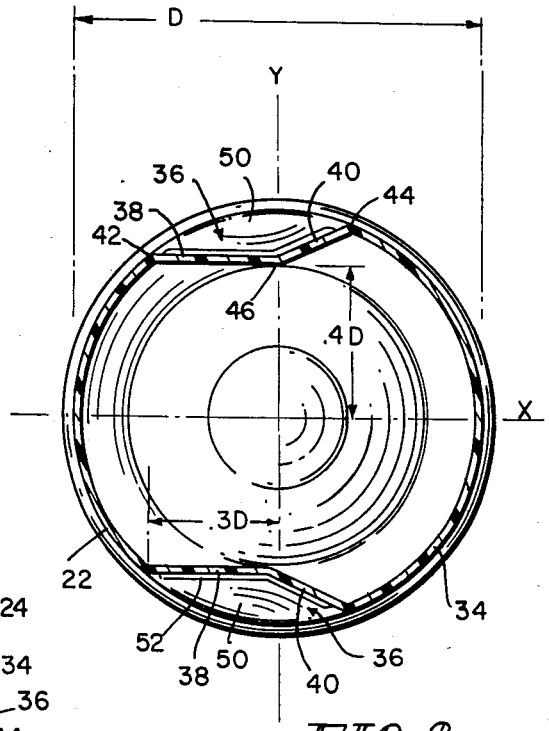
FIG. 2 is a sectional view of the bottle of FIG. 1 taken along lines 2—2.

As can best be seen in FIG. 2, the second vertical surface 40 is inclined with respect to the fist vertical surface 38 at an obtuse angle somewhat more than 145°. The first surfaces 38 of the two indentations 36 are shown to be substantially parallel to each other and substantially parallel to a medial plane X vertically bisecting the container 10 of diameter D. The common edges 46 joining the first and second vertical surfaces 38 and 40 are shown to lie on a common diameter Y normal to the medial plane X and spaced from the axis about 0.4 times the diameter D.

The vertical length of the first vertical plane 38 shown to be about 60% of the vertical length of the body portion 22. The horizontal width of the first vertical plane 38 is shown to be about twice the width of the second vertical surface 40. Horizontal width of the first vertical surface is about 0.3 times the diameter D of the cylindrical body portion of the container.

Figure 3:
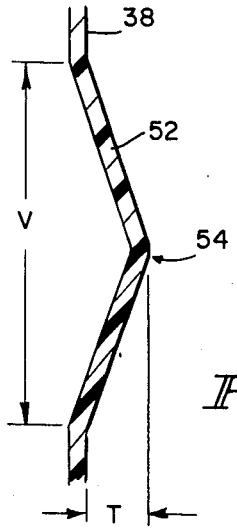
FIG. 3 is a detailed enlarged dead sectional view of a reinforcing rib as shown in FIG. 1 taken along line 3—3.

A plurality of reinforcing means 52 are provided which extend continuously over at least a major portion of the horizontal width of the first and second surfaces 38 and 40 and the common edge 46, the reinforcing means inhibiting the everting of the indentations 36. As illustrated, the reinforcing means comprise a plurality of horizontal ribs projecting outward from the first and second surfaces. FIG. 3 shows an enlarged detailed view of the preferred embodiment of the reinforcing ribs where the ribs are generally triangular in cross section and the angle at the apex 54 of the ribs is about 140°. The outermost portion of the rib projects outwardly a distance T which is about three or four times the average wall thickness of the body portion 22 of the container. In a 1.75 liter container as illustrated the vertical dimension V of each reinforcing rib is about $\frac{3}{8}$ of an inch.

In tests conducted on bottles constructed in accordance with the present invention, the bottles have been filled with liquid and dropped at varyinq heights. While the hand-grip indentations on similar prior art bottles evert when dropped between one and two feet, the hand-grip portion of the bottles of the present invention do not evert even when dropped distances exceeding six feet.

Although the invention has been described in detail with reference to the illustrated preferred embodiment, variations and modifications exist within the scope and spirit of the invention as described and as defined in the following claims:

What is claimed is:

1. A thin-walled container composed of a strain-hardened polymer, comprising a neck portion defining an opening, a bottom portion, and a body portion intermediate the neck and bottom portions, the body portion including a generally cylindrical side wall of diameter D and an opposed pair of indentations to permit the container to be grasped between a thumb and fingers of one hand, the indentations each comprising a first vertical surface and a second vertical surface, the surfaces having outside vertical edges which are continuously joined to the cylindrical side wall, the first and second surfaces of each indentation having a common edge continuously joining the two surfaces, the second surface being inclined with respect to the first surface at an obtuse angle, and a plurality of vertically spaced-apart horizontal ribs extending continuously over at least a major portion of the horizontal width of both the first and second surfaces and the common edge, the outermost surfaces of the ribs extending parallel to the first and second surfaces and including a demarcation coincident with the common edge for inhibiting the everting of the indentations.

2. The container of claim 1 wherein the two first surfaces are situated substantially parallel to each other and to a medial plane vertically bisecting the container.

3. The container of claim 1 wherein the second surface is inclined with respect to the first surface at an angle greater than about 145°.

4. The container of claim 1 wherein the horizontal width of the first surface is about twice the horizontal width of the second surface.

5. The container of claim 1 wherein the horizontal width of the first surface is about 0.3 D.

6. The container of claim 1 wherein the reinforcing ribs project outwardly from the first and second surfaces.

7. The container of claim 6 wherein the ribs are generally triangular in cross section.

8. The container of claim 7 wherein the apex angle of the ribs in cross section is about 140°.

9. The container of claim 6 wherein the ribs project outwardly about 3 to 4 times the average wall thickness of the body portion of the container.

10. The container of claim 1 wherein the common edge joining the first and second surfaces is situated at about 0.4 D from the axis of the container.

11. The container of claim 1 wherein the common edge of both indentations are situated on a common diameter.

12. The container of claim 1 wherein the indentations each further include upper and lower triangular portions unitarily joining top and bottom edges of the first and second surfaces to the cylindrical body portions.

* * * * *

UNITED STATES PATENT AND TRADEMARK OFFICE

CERTIFICATE OF CORRECTION

PATENT NO. : 4,804,097

DATED : February 14, 1989

INVENTOR(S) : Alfred C. Alberghini and Stephen R. Lynn

It is certified that error appears in the above-identified patent and that said Letters Patent is hereby corrected as shown below:

On the bibliography page, under the heading "FOREIGN PATENT DOCUMENTS", please delete "1985587" and insert therefor --198587--;

At column 3, line 4, please delete "fist" and insert therefor --first--; and

At column 3, line 15, before the word "shown", please insert the word --is--.

Signed and Sealed this

Fourth Day of July, 1989

*Attest:*

*Attesting Officer*

DONALD J. QUIGG

*Commissioner of Patents and Trademarks*